US010759173B2

(12) United States Patent
Ohkura et al.

(10) Patent No.: US 10,759,173 B2
(45) Date of Patent: Sep. 1, 2020

(54) WIPING MEMBER, WIPING METHOD, AND WIPING DEVICE

(71) Applicants: Hiroko Ohkura, Kanagawa (JP); Yohta Sakon, Kanagawa (JP); Akira Izutani, Osaka (JP); Takumi Atake, Kanagawa (JP)

(72) Inventors: Hiroko Ohkura, Kanagawa (JP); Yohta Sakon, Kanagawa (JP); Akira Izutani, Osaka (JP); Takumi Atake, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/423,261

(22) Filed: May 28, 2019

(65) Prior Publication Data

US 2019/0366721 A1 Dec. 5, 2019

(30) Foreign Application Priority Data

May 30, 2018 (JP) ..... 2018-103160
Jan. 8, 2019 (JP) ..... 2019-001463

(51) Int. Cl.
*B41J 2/165* (2006.01)

(52) U.S. Cl.
CPC ..... *B41J 2/16552* (2013.01); *B41J 2/16535* (2013.01); *B41J 2002/1655* (2013.01); *B41J 2002/16558* (2013.01)

(58) Field of Classification Search
CPC ..... B41J 2/16522; B41J 2/16535; B41J 2002/1655; B41J 2002/16558; B41J 2/16517
See application file for complete search history.

(56) References Cited

U.S. PATENT DOCUMENTS

2007/0076047 A1* 4/2007 Katada ..... B41J 2/16538 347/33
2019/0283430 A1* 9/2019 Atake ..... B41J 2/16552

FOREIGN PATENT DOCUMENTS

JP 2007-125882 5/2007
JP 2014-188900 10/2014
WO WO2016/047193 A1 3/2016

* cited by examiner

*Primary Examiner* — Sharon A. Polk
(74) *Attorney, Agent, or Firm* — Oblon, McClelland, Maier & Neustadt, L.L.P.

(57) ABSTRACT

A wiping member that wipes a nozzle surface of a liquid discharging head, includes a first region having an average porosity P1, a second region disposed on the first region, having an average porosity P2 greater than P1, and a third region disposed on the second region having an average porosity P3 greater than P2, wherein the wiping member has a thickness t in the direction perpendicular to the surface that contacts the nozzle surface and each of the first region, the second region, and the third region has a thickness of t/3 in the direction, wherein P2/P1 is from 1.1 to 1.4.

14 Claims, 3 Drawing Sheets

WIPING MEMBER, WIPING METHOD, AND WIPING DEVICE

CROSS-REFERENCE TO RELATED APPLICATIONS

This patent application is based on and claims priority pursuant to 35 U.S.C. § 119 to Japanese Patent Application Nos. 2018-103160 and 2019-001463, filed on May 30, 2018 and Jan. 8, 2019, respectively, in the Japan Patent Office, the entire disclosures of which are hereby incorporated by reference herein.

BACKGROUND

Technical Field

The present disclosure relates to a wiping member, a wiping method, and a wiping device.

Description of the Related Art

Liquid discharging heads in a liquid discharging device represented by an inkjet printer may cause a problem such as discharging failure due to foreign matter on the nozzle surface. For example, when a liquid that has been left for a long time without discharging or a liquid having a highly drying property is discharged, the liquid is thickened in a liquid flow path near the discharging orifice, which prevents normal discharging.

For such discharging failure, methods of returning liquid discharging to normal are known such that the discharging surface of a recording head is capped to prevent a liquid from being thickened when not discharging the liquid (capping), thickened liquid is suctioned from a discharging orifice and ejected while the discharging surface is capped (liquid suctioning), and thickened liquid is discharged to a liquid receiver containing a liquid absorber like normal discharging (dummy discharging). In addition, another method is known which includes cleaning the nozzle surface of a liquid discharging head by relatively moving a sheet-like wiping member typified by a non-woven fabric or a woven fabric while the wiping member is brought into contact with the nozzle surface.

SUMMARY

According to embodiments of the present disclosure, a wiping member that wipes a nozzle surface of a liquid discharging head is provided which includes a first region having an average porosity P1, a second region disposed on the first region, having an average porosity P2 greater than P1, and a third region disposed on the second region having an average porosity P3 greater than P2, wherein the wiping member has a thickness t in the direction perpendicular to the surface that contacts the nozzle surface and each of the first region, the second region, and the third region has a thickness of t/3 in the direction, wherein P2/P1 is from 1.1 to 1.4.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
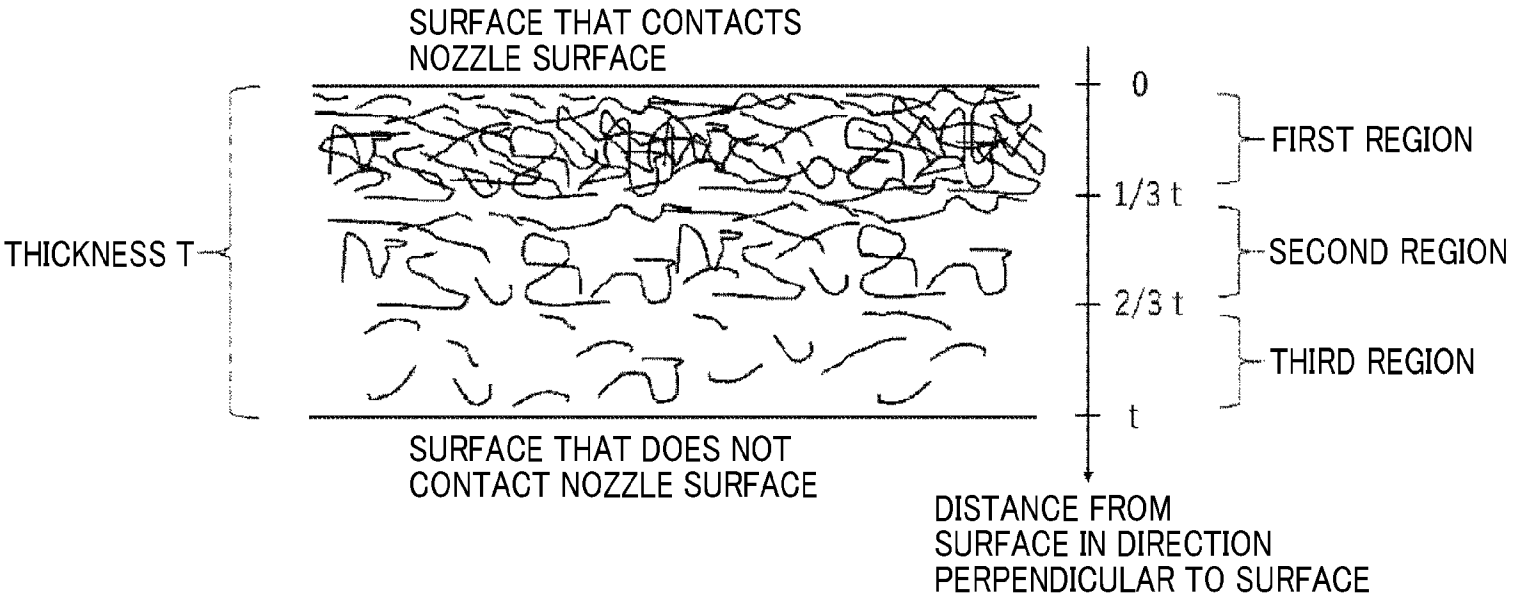
FIG. 1 is a schematic diagram illustrating an example of the cross section of the sheet-like wiping member.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A wiping member has been proposed for the purpose of securing the absorption capacity of a wiping member that absorbs liquid adhering to the nozzle surface while diminishing the entry of air bubbles into the nozzle when the nozzle surface is wiped by the wiping member. Specifically, one surface of the wiping member is in contact with the nozzle surface on which nozzles for discharging droplets are formed and a plurality of voids forming a capillary from the one surface side to the other surface side are formed in the wiping member. The void situated in the other surface side is larger than that in the one surface side. The wiping member is formed by knitting a yarn bundle formed by bundling yarns, and the yarn bundle on the other side is bundled more tightly than the yarn bundle on the one surface side and the void between the yarn bundles is larger on the other surface side than on the one surface side.

However, it is not easy to efficiently remove liquid adhering matter on the nozzle surface and absorb extra liquid on the nozzle surface at the same time.

According to the present disclosure, a wiping member is provided which is capable of efficiently removing liquid adhering matter on a nozzle surface and absorbing extra liquid on the nozzle surface at the same time.

Next, aspects of the present disclosure are described.

Wiping Member

The wiping member of the present embodiment wipes the nozzle surface of a liquid discharging head which discharges a liquid through nozzles by contact with the nozzle surface. In the present embodiment, "wipe" refers to relatively moving the wiping member and the liquid discharging head to each other while bringing the wiping member and the nozzle surface into contact with each other. By wiping the nozzle surface using the wiping member of the present embodiment, for example, it is possible to remove from the nozzle surface the liquid adhering matter such as a cap mark appearing as a result of capping the nozzle surface for a long time. In addition, for example, it is possible to remove from the nozzle surface by absorbing extra liquid such as liquid overflowing from the nozzle caused by dummy discharging.

The wiping member of the present embodiment that wipes a nozzle surface of a liquid discharging head includes a first region having an average porosity P1, a second region disposed on the first region, having an average porosity P2 greater than P1, and a third region disposed on the second region having an average porosity P3 greater than P2, wherein the wiping member has a thickness t in the direction perpendicular to the surface that contacts the nozzle surface and each of the first region, the second region, and the third region has a thickness of t/3 in the direction, wherein P2/P1 is from 1.1 to 1.4. In one embodiment, the first region extends from the surface to t/3, the second region extends from t/3 to 2t/3, and the third region extends from 2t/3 to t.

First, the wiping member will be described with reference to FIG. 1. FIG. 1 is a schematic diagram illustrating an example of the cross section of a sheet-like wiping member. The wiping member illustrated in FIG. 1 is a single-layer non-woven fabric, and has a surface that is brought into contact with the nozzle surface of the liquid discharging head to wipe the nozzle surface and a back surface not in contact with the nozzle surface. Moreover, as illustrated in FIG. 1, the wiping member of the present embodiment has a thickness t from the surface towards the back surface in the perpendicular direction of the surface. In addition, the first region is from the surface (i.e., zero) to t/3 in the vertical direction of the surface that contacts the nozzle surface, the second region occupies between t/3 and 2t/3 in the vertical direction of the surface, and the third region occupies between 2t/3 and t in the vertical direction of the surface. The boundary value t/3 of the first region and the second region is not included in the first region but in the second region. The boundary value 2t/3 of the second region and the third region is not included in the second region but in the third region. When the average porosity of the first region is P1, the average porosity of the second region is P2, and the average porosity of the third region is P3, the following relation is satisfied: P1<P2<P3. Also, the ratio P2/P1 is from 1.1 to 1.4 and preferably from 1.2 to 1.3. As the average porosity P1 in the first region having a surface in contact with the nozzle surface decreases, it is possible to enhance the scraping force of the liquid adhering matter. In addition, when the ratio P2/P1 of the average porosity is set to 1.1 to 1.4, which makes a difference of the average porosity between the first region and the second region, and the average porosity P3 is set to be greater than the average porosity P2, the extra liquid on the nozzle surface can be quickly absorbed to the inside of the wiping member. This makes it possible to efficiently remove liquid adhering matter on the nozzle surface and absorb extra liquid on the nozzle surface at the same time.

In the present embodiment, the average porosity P1, P2, and P3 of each region is calculated by, for example, the following method.

First, a 1 cm square of the wiping member is cut out and the cross section thereof is observed with a laser microscope to obtain the thickness t of the wiping member in the vertical direction of the surface. Next, in the first region identified from the thickness t, cross-section images are taken at five points, and the porosity is calculated by calculating "the area occupied by the void portion/the area of the wiping member" in each image. The average of the five porosity values is determined as the average porosity P1. The average porosity P2 is determined from the cross-section image of the second region and the average porosity P3 is determined from the cross-section image of the third region in the same manner as for the average porosity P1. The "area of the wiping member" means the sum of the area occupied by the material of the wiping member and the area occupied by the void portion of the wiping member. Further, the thickness t may be measured by using a micrometer, a laser displacement meter, etc., other than the laser microscope.

The average porosity P1 is preferably from 0.50 to 0.84, more preferably from 0.60 to 0.80, furthermore preferably from 0.60 to 0.75, and particularly preferably from 0.65 to 0.75. When the average porosity P1 is 0.50 or more, the wiping member can easily take in the liquid adhering material into the wiping member. When it is 0.84 or less, the contact area of the fibers of the wiping member in contact with the liquid adhering material is increased, thereby enhancing the power of scraping the liquid adhering material by the wiping member.

The average porosity P2 is preferably from 0.55 to 0.94, more preferably from 0.66 to 0.94, furthermore preferably from 0.80 to 0.94, and particularly preferably from 0.85 to 0.94. Since the wiping member has an average porosity P2 of from 0.55 to 0.94, the drop in the scraping power of the liquid adhering material is diminished and the extra liquid absorbed in the first region is quickly guided to the third region.

The average porosity P3 is preferably from 0.65 to 0.99, more preferably from 0.80 to 0.99, furthermore preferably from 0.85 to 0.99, and particularly preferably from 0.90 to 0.99. When the average porosity P3 is from 0.65 to 0.99, the amount of extra liquid that can be absorbed is increased.

The thickness t of the wiping member is preferably from 0.1 to 3.0 mm and more preferably from 0.2 to 1.7 mm. When the thickness t of the wiping member is 0.1 mm or more, the saturated water absorption amount of the liquid per unit area of the wiping member becomes good, and the liquid to be wiped can be sufficiently absorbed. In addition, when the thickness t of the wiping member is 3.0 mm or less, the device can be miniaturized.

As the wiping member in the present embodiment, for example, a single-layer wiping member in which the porosity continuously changes, and a multiple layered wiping member in which the porosity changes stepwise due to a plurality of members combined with a bonding material such as an adhesive. Although it can be suitably selected and used to suit to a particular application, the single-layer wiping member is preferable. Due to the usage of the single-layer wiping member mentioned above, the speed of absorbing the extra liquid on the nozzle surface is increased. Furthermore, if the single-layer wiping member is used, it obviates the need for joining the plurality of members constituting the wiping member with a bonding material such as an adhesive. This prevents the absorption efficiency of the liquid from decreasing due to the bonding material such as an adhesive. Also, the liquid can be quickly absorbed to the vicinity of the back surface of the wiping member. In addition, since the bonding material such as an adhesive does not melt out when the wiping member is used, it is possible to reduce the influence on the member such as the nozzle surface with which the wiping member is brought into contact.

The wiping member in the present embodiment can be appropriately selected from non-woven fabric, woven fabric, knitting, etc., to suit to a particular application. Preferably, at least the surface of the wiping member is a non-woven fabric and more preferably, the wiping member is entirely a non-woven fabric. While the direction of fibers of woven fabric and knitting is a particular direction, the direction of fibers of non-woven fabric is random. Therefore, when wiping the liquid adhering material on the nozzle surface, the contact area between the wiping member and the liquid adhering material increases and the wiping member and the liquid adhering material become easily entangled, thereby increasing the removal efficiency of the liquid adhering material.

Specific examples of the materials of the wiping member include, but are not limited to, cotton, hemp, silk, pulp, nylon, vinylon, polyester, polypropylene, polyethylene, rayon, cupra, acrylic, and polylactic acid. Not only the wiping member made of one type of material but also a wiping member in which a plurality of types of materials are mixed may be used.

The wiping surface of the wiping member desirably has a surface roughness Rz of 170 μm or more obtained by surface roughness measurement by using, for example, a laser microscope. When the surface roughness Rz of the wiping surface is 170 μm or more, the meniscus in the nozzle is not easily broken so that the nozzle surface can be wiped while reducing defective discharging.

A method of manufacturing a non-woven fabric wiping member will be described. Examples of the method of forming a non-woven fabric include, but are not limited to, wet, dry, spun-bond, melt-blown and flash spinning. Moreover, the non-woven fabric can be bonded by, for example, methods such as spun lace, needle punch, thermal bond, chemical bond, etc. In the spun lace method, jet water stream is sprayed onto accumulated fibers to entangle the fibers due to the pressure, thereby bonding the fibers like a sheet. The needle-punch method forms a non-woven fabric by stabbing a needle with a protrusion called a barb into accumulated fibers several ten times or more to mechanically intertwine the fibers. Fiber layers are laminated in the order of a coarse layer, a middle layer, and a dense layer so that the fiber density increases one layer by one layer. Thereafter, the constituent fibers are mutually entangled and integrated by the spun lace method, needle punch method, etc., to obtain a single layer non-woven fabrics in which the porosity sequentially changes.

The wiping member may be combined with another member for the purpose other than liquid wiping. For example, a film, etc., may be lined for the purpose of preventing strike-through of the absorbed liquid or enhancing the strength of the wiping member.

Wiping Device

The wiping device according to the present embodiment includes the above-described wiping member and wipes a nozzle surface by bringing the wiping member into contact with the nozzle surface. In addition, the wiping device optionally has a cleaning liquid applying device to apply a cleaning liquid to the wiping member.

Figure 2:
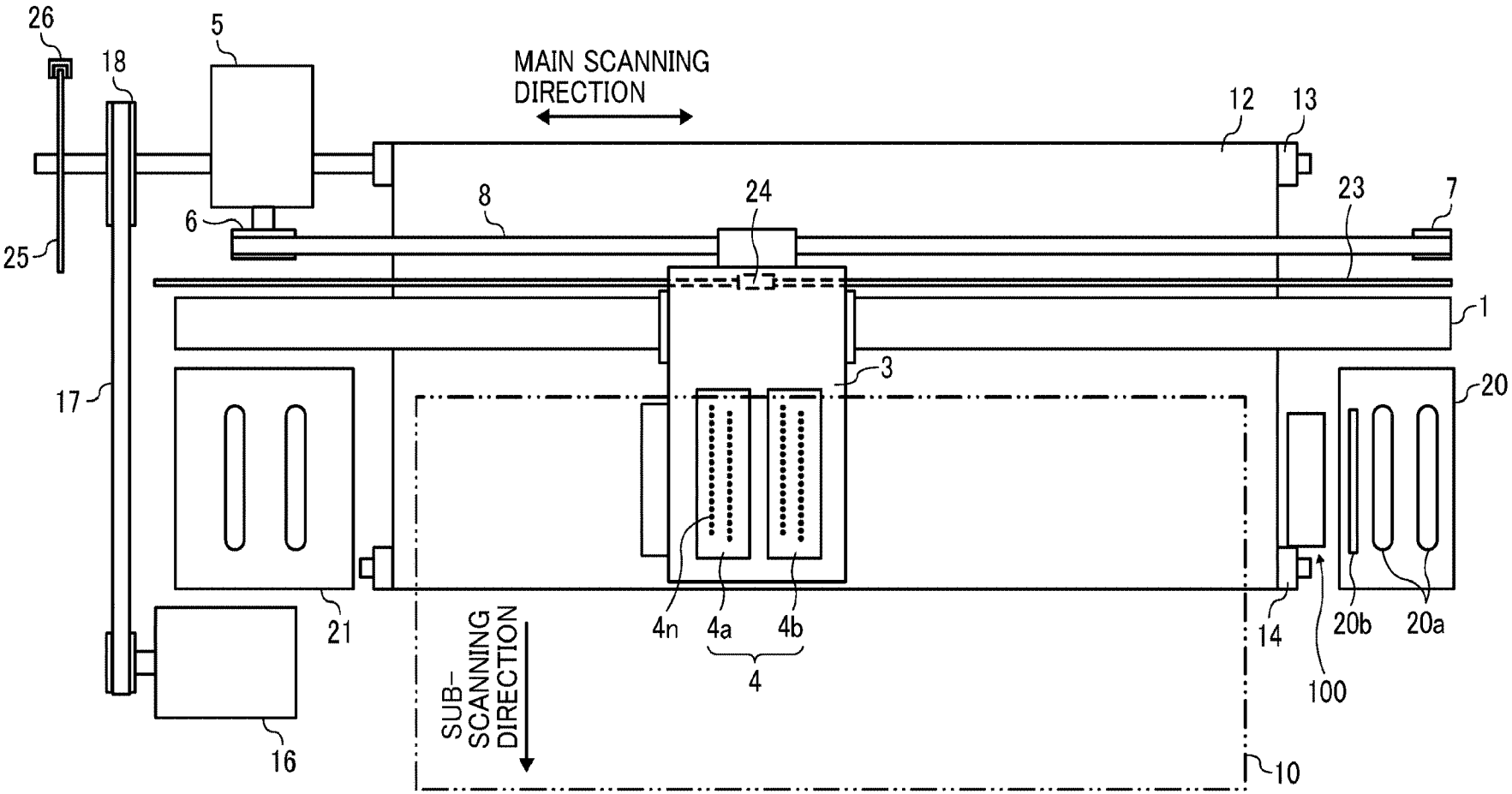
FIG. 2 is a schematic diagram illustrating an example of an image forming device incorporating a wiping device.
Figure 3:
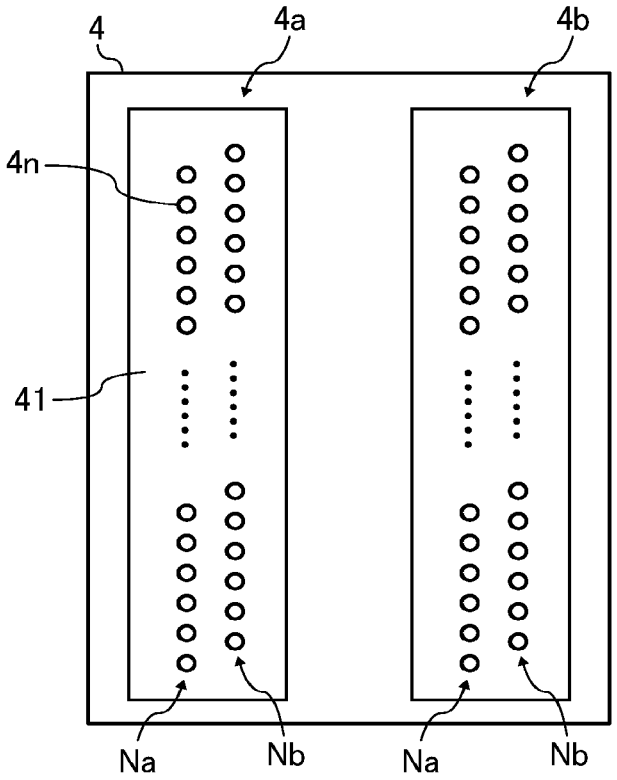
FIG. 3 is a schematic diagram illustrating an example of the nozzle surface of a liquid discharging head.
Figure 4:
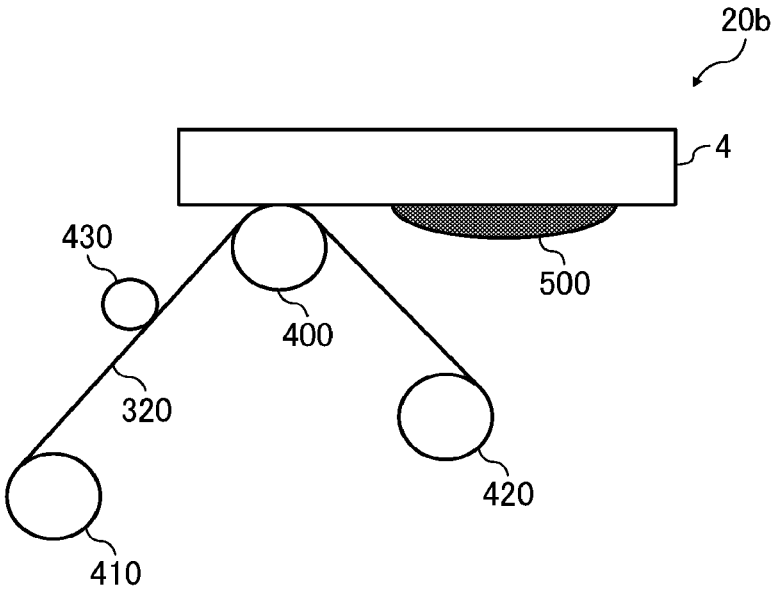
FIG. 4 is a schematic diagram illustrating an example of a wiping device.

Next, the wiping device will be described taking an image forming device as an example which incorporates the wiping device with reference to FIGS. 2 and 3. The image forming device discharges ink as an example of the liquid. FIG. 2 is a schematic diagram illustrating an example of an image forming device incorporating the wiping device. FIG. 3 is a schematic diagram illustrating an example of the nozzle surface of a liquid discharging head. FIG. 4 is a schematic diagram illustrating an example of the wiping device.

The image forming device illustrated in FIG. 2 is a serial type liquid discharging device. The image forming device includes a carriage 3 which is movably held by a main guide member 1 and a sub-guide member, that are bridged between left and right side plates. A main scanning motor 5 drives the carriage 3 to reciprocate in the main scanning direction (carriage moving direction) via a timing belt 8 looped around a drive pully 6 and a driven pully 7. The carriage 3 carries recording heads 4*a* and 4*b* (referred to as recording head 4 if distinction thereof is not necessary) as examples of the liquid discharging heads. The recording head 4 discharges color ink droplets of, for example, yellow (Y), cyan (C), magenta (M), and black (K). The recording head 4 carries nozzle arrays each having multiple nozzles 4*n* disposed along the sub-scanning direction vertical to the main scanning direction with the ink discharging surface downward.

As illustrated in FIG. 3, the recording head 4 has two nozzle arrays Na and Nb, each including multiple nozzles 4*n*, on a nozzle surface 41. As the liquid discharging head constituting the recording head 4, for example, it is possible to use a piezoelectric actuator such as a piezoelectric element and a thermal actuator that utilizes the phase change caused by film boiling of liquid by using an electric heat conversion element such as a heat element.

The image forming device illustrated in FIG. 2 has a conveyor belt 12 serving as a conveying device to convey a sheet 10 by electrostatic adsorption at the position facing the recording head 4. The conveyor belt 12 takes an endless form and looped around a conveyor roller 13 and a tension roller 14. The conveyor belt 12 is circularly moved in the sub-scanning direction by the conveyor roller 13 rotationally driven by a sub-scanning motor 16 via a timing belt 17 and a timing pully 18. This conveyor belt 12 is charged (charges are applied) by a charging roller while moving in a circular manner.

At one end in the main-scanning direction of the carriage 3, a maintenance and recovery mechanism 20 configured to maintain and recover the recording head 4 is disposed beside the conveyor belt 12. On the other end, a dummy discharging receiver 21 configured for dummy discharging by the recording head 4 is disposed beside the conveyor belt 12. The maintenance and recovery mechanism 20 includes, for example, a capping member 20*a* to cap the nozzle surface (surface on which the nozzle is formed) 41 of the recording head 4, a wiping mechanism 20*b* to wipe the nozzle surface, and the dummy discharging receiver that receives droplets not used for forming an image.

Further, the image forming device includes an encoder scale 23 that has a predetermined pattern and is stretched between both side plates along the main scanning direction of the carriage 3. Further, the carriage 3 includes an encoder sensor 24 formed of a transmission type photo sensor that reads the pattern of the encoder scale 23. These encoder scale 23 and the encoder sensor 24 constitute a linear encoder (main scanning encoder) to detect the movement of the carriage 3.

In addition, a cord wheel 25 is mounted onto the shaft of the conveyor roller 13, and an encoder sensor 26 is provided which has a transmissive photosensor to detect the pattern formed on the code wheel 25. These code wheel 25 and encoder sensor 26 constitute a rotary encoder (sub-scanning encoder) to detect the moving and the position of the conveyor belt 12.

In the image forming device having such a configuration, the sheet 10 is fed onto the charged conveyor belt 12, adsorbed thereto, and conveyed along the sub-scanning direction in accordance with the rotation of the conveyor belt 12. By driving the recording head 4 in response to the image signal while moving the carriage 3 in the main-scanning direction, ink droplets are discharged onto the sheet 10 standing still to record an image in an amount of one line. After the sheet 10 is conveyed in a predetermined amount, the next line is recorded. On receiving a signal indicating that the recording is finished or the rear end of the sheet 10 has reached the image recording region, the recording operation stops, and the sheet 10 is ejected to an ejection tray.

In addition, the carriage 3 is moved in the printing (recording) standby mode to the maintenance and recovery mechanism 20 to clean the recording head 4 by the maintenance and recovery mechanism 20. Alternatively, the recording head 4 may not be moved and the maintenance and recovery mechanism 20 may move to clean the recording head 4. The recording head 4 illustrated in FIG. 2 has two nozzle arrays Na and Nb, each including multiple nozzles 4*n*, as illustrated in FIG. 3. The nozzle array Na of the recording head 4*a* discharges black (K) liquid droplets and the other nozzle array Nb discharges cyan (C) liquid droplets. The nozzle array Na of the recording head 4*b* discharges magenta (M) liquid droplets and the other nozzle array Nb discharges yellow (Y) liquid droplets.

An example of the wiping device is the mechanism 20*b* to wipe the nozzle surface. As illustrated in FIG. 4, the mechanism 20*b* includes a sheet-like wiping member 320, which is an example of the wiping member, a delivery roller 410 to deliver the sheet-like wiping member 320, a cleaning liquid application roller 430, which is an example of the cleaning liquid application device to apply a cleaning liquid to the sheet-like wiping member 320, a pressing roller 400 to press the sheet-like wiping member 320 to which the cleaning liquid has been applied against the nozzle surface, and a reel-up roller 420 to collect the sheet-like wiping member 320 used for wiping. In addition to the sheet-like wiping member 320, the mechanism 20*b* to wipe the nozzle surface may optionally include a rubber blade, etc., to wipe the nozzle surface. The pressing force of the pressing roller 400 can be adjusted by adjusting the distance between the cleaning unit and the nozzle surface by a spring. The pressing member is not limited to a roller but can be a fixed member made of plastic or rubber. When the mechanism 20*b* includes a rubber blade, etc., a mechanism of bringing the rubber blade, etc., into contact with the sheet-like wiping member 320 is provided to impart a cleaning ability of the rubber blade, etc., to the sheet-like wiping member 320.

Cleaning Liquid

The cleaning liquid contains an organic solvent, water, a surfactant, etc., and preferably has a surface tension of 35 mN/m or less. When the sheet-like wiping member 320 wipes the nozzle surface after the cleaning liquid is applied thereto, viscosity of the liquid adhering material formed on the nozzle surface is reduced, which makes it easy to remove the liquid adhering matter. For example, for the ink-fixed matter, which is an example of the liquid adhering matter on the nozzle surface and appears as a result of making the image forming device standby for a long time, it is preferable that the cleaning liquid is applied to the sheet-like wiping member 320 and thereafter the nozzle surface is wiped by the sheet-like wiping member 320 multiple times or for a specific period of time.

Organic Solvent

There is no specific limitation to the organic solvent for use in the cleaning liquid. For example, water-soluble organic solvents can be used. Examples include, but are not limited to, polyols, ethers such as polyol alkylethers and polyol arylethers, nitrogen-containing heterocyclic compounds, amides, amines, and sulfur-containing compounds.

Specific examples of the polyol include, but are not limited to, ethylene glycol, diethylene glycol, 1,2-propanediol, 1,3-propane diol, 1,2-butanediol, 1,3-butanediol, 1,4-butanediol, 2,3-butanediol, 3-methyl1,3-butanediol, trethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzylether.

Specific examples of nitrogen-containing heterocyclic compounds include, but are not limited to, 2-pyrolidone, N-methyl-2-pyrolidone, N-hydroxyethyl-2-pyrolidone, 1,3-dimethyl-2-imidazoline, ε-caprolactam, and γ-butylolactone.

Specific examples of the amide include, but are not limited to, formamide, N-methyl formamide, N,N-di methyl formamide, 3-m ethoxy-N,N-dimethyl propionamide, and 3-buthoxy-N,N-dimethylpropionamide.

Specific examples of the amine include, but are not limited to, monoethanol amine, diethanol amine, and triethyl amine.

Specific examples of the sulfur-containing compounds include, but are not limited to, dimethyl sulphoxide, sulfolane, and thiodiethanol.

Also, for example, propylene carbonate, ethylene carbonate, etc. can be used as the organic solvent.

Polyol compounds having eight or more carbon atoms and glycol ether compounds are also suitable as the organic solvent.

Specific examples of the polyol compounds having eight or more carbon atoms include, but are not limited to, 2-ethyl-1,3-hexanediol and 2,2,4-trimethyl-1,3-pentanediol. Specific examples of the glycolether compounds include, but are not limited to, polyol alkylethers such as ethyleneglycol monoethylether, ethyleneglycol monobutylether, diethyleneglycol monomethylether, diethyleneglycol monoethylether, diethyleneglycol monobutylether, tetraethyleneglycol monomethylether, and propyleneglycol monoethylether; and polyol arylethers such as ethyleneglycol monophenylether and ethyleneglycol monobenzylether.

The proportion of the organic solvent in the cleaning liquid is not particularly limited and can be suitably selected to suit to a particular application. For example, it is preferably from 10 to 60 percent by mass and more preferably from 20 to 60 percent by mass.

Water

The proportion of water in the cleaning liquid has no particular limit. In terms of the drying property and discharging reliability of the cleaning liquid, the proportion is preferably from 10 to 90 percent by mass and more preferably from 20 to 60 percent by mass.

Examples of the surfactant include, but are not limited to, silicone-based surfactants, fluorochemical surfactants, amphoteric surfactants, nonionic surfactants, anionic surfactants, etc.

The silicone-based surfactant has no specific limit and can be suitably selected to suit to a particular application. Of these, silicone-based surfactants not decomposed even in high pH environment are preferable. The silicone-based surfactants include, for example, side chain-modified polydimethyl siloxane, both distal end-modified polydimethyl siloxane, one distal end-modified polydimethyl siloxane, and side chain both distal end-modified polydimethyl siloxane. As the modification group, it is particularly preferable to select a polyoxyethylene group or polyoxyethylene polyoxypropylene group because these demonstrate good properties as aqueous surfactants. It is possible to use a polyether-modified silicone-based surfactant as the silicone-based surfactant. A specific example is a compound in which a polyalkylene oxide structure is introduced into the side chain of the Si site of dimethyl siloxane.

Specific examples of the fluorochemical surfactant include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because the fluorochemical surfactant does not easily produce foams.

Specific examples of the perfluoroalkyl sulfonic acid compounds include, but are not limited to, a perfluoroalkyl sulfonic acid and a salt of perfluoroalkyl sulfonic acid.

Specific examples of the perfluoroalkyl carboxylic acid compounds include, but are not limited to, a perfluoroalkyl carboxylic acid and a salt of perfluoroalkyl carboxylic acid.

Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain, and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactant has no particular limit and can be suitably selected to suit to a particular application.

Specific examples include, but are not limited to, side-chain-modified polydimethyl siloxane, both distal-end-modified polydimethylsiloxane, one-distal-end-modified polydimethylsiloxane, and side-chain-both-distal-end-modified polydimethylsiloxane. In particular, a polyether-modified silicone-based surfactant having a polyoxyethylene group or a polyoxyethylene polyoxypropylene group is particularly preferable because such a surfactant demonstrates good property as an aqueous surfactant.

Any suitably synthesized surfactant and any product available on the market is suitable. Products available on the market can be obtained from BYK-Chemie GmbH, Shin-Etsu Chemical Co., Ltd., Dow Corning Toray Co., Ltd., NIHON EMULSION Co., Ltd., Kyoeisha Chemical Co., Ltd., etc.

The polyether-modified silicon-based surfactant has no particular limit and can be suitably selected to suit to a particular application. For example, a compound is usable in which the polyalkylene oxide structure represented by the following Chemical formula S-1 is introduced into the side chain of the Si site of dimethyl polysiloxane.

Chemical formula S-1

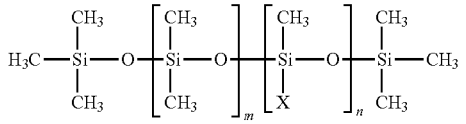

$$X = \text{—}R(C_2H_4O)_a(C_3H_6O)_b R'$$

In Chemical formula S-1, "m", "n", "a", and "b" each, respectively independently represent integers, R represents an alkylene group, and R' represents an alkyl group.

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Chemie GmbH), and TSF4440, TSF4452, and TSF4453 (all manufactured by Momentive Performance Materials Inc.).

The fluorochemical surfactant is preferably a compound having 2 to 16 fluorine-substituted carbon atoms and more preferably a compound having 4 to 16 fluorine-substituted carbon atoms.

Specific examples of the fluorochemical surfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in the side chain thereof are preferable because these polymer compounds do not easily foam and the fluorosurfactant represented by the following Chemical formula F-1 or Chemical formula F-2 is more preferable.

$$CF_3CF_2(CF_2CF_2)_m\text{—}CH_2CH_2O(CH_2CH_2O)_nH$$ Chemical formula F-1

In the compound represented by Chemical formula F-1, m is preferably 0 or an integer of from 1 to 10 and n is preferably 0 or an integer of from 1 to 40.

$$C_nF_{2n+1}—CH_2CH(OH)CH_2—O—(CH_2CH_2O)_a—Y \quad \text{Chemical formula F-2}$$

In the compound represented by Chemical formula F-2, Y represents H or $C_mF_{2m+1}$, where m represents an integer of from 1 to 6, or $CH_2CH(OH)CH_2—C_mF_{2m+1}$, where m represents an integer of from 4 to 6, or $C_pH_{2p+1}$, where p is an integer of from 1 to 19. "n" represents an integer of from 1 to 6. "a" represents an integer of from 4 to 14.

As the fluorochemical surfactant, products available on the market may be used. Specific examples include, but are not limited to, SURFLON S-111, S-112, S-113, S-121, S-131, S-132, S-141, and S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFACE F-470, F-1405, and F-474 (all manufactured by DIC CORPORATION); ZONYL TBS, FSP, FSA, FSN-100, FSN, FSO-100, FSO, FS-300, UR, and Capstone™ FS-30, FS-31, FS-3100, FS-34, and FS-35 (all manufactured by The Chemours Company); FT-110, FT-250, FT-251, FT-400S, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.); and UNIDYNE™ DSN-403N (manufactured by DAIKIN INDUSTRIES, Ltd.). Of these, FS-3100, FS-34, and FS-300 of The Chemours Company, FT-110, FT-250, FT-251, FT-400S, FT-150, and FT-400SW of NEOS COMPANY LIMITED, POLYFOX PF-151N of OMNOVA SOLUTIONS INC., and UNIDYNE™ DSN-403N (manufactured by DAIKIN INDUSTRIES, Ltd.) are particularly preferable.

The proportion of the surfactant in the cleaning liquid is not particularly limited and can be suitably selected to suit to a particular application. For example, it is preferably from 0.001 to 5 percent by mass and more preferably from 0.05 to 5 percent by mass.

Properties of the cleaning liquid are not particularly limited and can be suitably selected to suit to a particular application. For example, viscosity, surface tension, and pH are preferably in the following ranges.

Viscosity of the cleaning liquid at 25 degrees C. is preferably from 5 to 30 mPa·s, and more preferably from 5 to 25 mPa·s. Viscosity can be measured by, for example, a rotatory viscometer (RE-80L, manufactured by TOKI SANGYO CO., LTD.). The measuring conditions are as follows:

Standard cone rotor (1°34'×R24)

Sample liquid amount: 1.2 mL

Rotational frequency: 50 rotations per minute (rpm)

25 degrees C.

Measuring time: three minutes

Surface tension of the cleaning liquid is preferably 35 mN/m or less and more preferably 32 mN/m or less at 25 degrees C.

pH of the cleaning liquid is preferably from 7 to 12 and more preferably from 8 to 11 in terms of prevention of corrosion of metal material in contact with liquid.

Wiping Method

The wiping method of the present embodiment includes wiping the nozzle surface by bringing the wiping member into contact with the nozzle surface using the above-described wiping member. In addition, the wiping method optionally includes applying a cleaning liquid to the wiping member. This cleaning method will be described with reference to FIG. 4.

Application of Cleaning Liquid

In the application of cleaning liquid, the cleaning liquid is applied to the sheet-like wiping member 320 using a cleaning liquid applying roller 430. The application amount of the cleaning liquid is preferably 30 μl/cm$^2$ or less. Within this range, when P2/P1 is from 1.1 to 1.4, the cleaning liquid applied to the sheet-like wiping member 320 uniformly oozes to the nozzle surface by bringing the sheet-like wiping member 320 into contact with the nozzle surface. This facilitates the removal of the liquid adhering material appearing on the nozzle surface.

Wiping

In the wiping, after the cleaning liquid is applied to the sheet-like wiping member 320, the sheet-like wiping member 320 and the recording head 4 relatively move to each other while pressing the sheet-like wiping member 320 against the nozzle surface, thereby wiping off a foreign matter 500 adhering to the nozzle surface. Examples of the foreign matter 500 adhering to the nozzle surface include, but are not limited to, mist ink produced during discharging of the ink from the nozzles, ink adhering to the nozzle surface when the ink is sucked from the nozzles during, for example, cleaning, adhesion ink which is dried mist ink or dried ink adhering to the cap member on the nozzle surface, and paper dust produced from printed matter.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

EXAMPLES

Next, the present disclosure is described in detail with reference to Examples but is not limited thereto.

Adjustment of Cleaning Liquid

The following components were mixed and stirred to prepare a cleaning liquid. The surface tension of this cleaning liquid was 28 mN/m as measured by a surface tensionmeter (CBVP—Z type, manufactured by Kyowa Interface Science Co., Ltd.).

3-methoxy-3-methyl-1-butanol (manufactured by KURARAY CO., LTD.): 20 percent by mass Polyether-modified silicone surfactant (WET270, manufactured by Evonik Degussa Japan Co., Ltd.): 1 percent by mass Deionized water: Balance

Examples 1 to 13 and Comparative Examples 1 to 4

Measurement of Average Porosity

The sheet-like wiping member having a structure and material shown in Table 1 was prepared. Next, 1 cm square was cut out from each wiping member, and the cross section thereof was observed with a laser microscope (LEXT OLS 4100, manufactured by Olympus Corporation) to secure a thickness t of the wiping member in the vertical direction to the surface. Next, cross-section images were taken at five points in the first region identified based on the thickness t and binarized into a fiber (material of the wiping member) and a gap (void) using an image analysis software (Image-Pro Plus, created by Nippon Roper). Thereafter, the porosity was calculated by calculating "the area occupied by the void portion/the area of the wiping member" in each image, and the average porosity P1, the average of the five porosity values, was calculated. The average porosity P2 was determined from the cross-section image of the second region and the average porosity P3 was determined from the cross-section image of the third region in the same manner as for the average porosity P1. The "area of the wiping member" means the sum of the area occupied by the material of the wiping member and the area occupied by the void portion of the wiping member. The average porosities P1, P2, and P3 and the ratio P2/P1 of each wiping member of Examples 1 to 13 and Comparative Examples 1 to 3 are shown in Table 1. In addition, "the non-woven fabric (multiple layer)" of Example 12 shown in Table 1 was obtained by bonding a plurality of non-woven fabrics with an adhesive.

Next, with respect to the wiping members of Examples 1 to 13 and Comparative Examples 1 to 4, the wiping properties of the liquid adhering material and the wiping properties of the extra liquid were evaluated according to the following method and evaluation criteria. The evaluation results are shown in Table 1.

Wiping Property of Liquid Adhering Matter 0.1 ml of RICOH Pro AR Ink White (manufactured by Ricoh Co., Ltd.) was dropped on the nozzle surface of the inkjet head (MH 5440, manufactured by Ricoh Co., Ltd.) and thereafter left for 15 hours to obtain ink adhering to the nozzle surface of the inkjet head. Next, the cleaning liquid was applied to a wiping member in such a manner that the amount was 10 μl/cm$^2$ and thereafter the nozzle surface of the inkjet head to which the ink adhered was wiped with the wiping member. The wiping conditions: pressing force of 3 N; and wiping speed of 50 mm/s. After the nozzle surface was wiped, the nozzle surface was visually observed to count the number of times of wiping required until the adhering ink was removed and evaluate the wiping properties according to the following evaluation criteria. The wiping member was determined as practically usable when graded C or above.

Evaluation Criteria

A: Ink adhering to nozzle surface was removed by wiping operations five times or less B: Ink adhering to nozzle surface was removed by wiping operations six or seven times C: Ink adhering to nozzle surface was removed by wiping operations eight to ten times D: Ink adhering to nozzle surface remained after wiping operations ten times Wiping Property of Extra Liquid 1 ml of RICOH Pro AR Ink White (manufactured by Ricoh Co., Ltd.) was dropped on the nozzle surface of the inkjet head (MH 5440, manufactured by Ricoh Co., Ltd.) to form extra ink adhering to the nozzle surface of the inkjet head. Next, the cleaning liquid was applied to a wiping member in such a manner that the amount was 10 μl/cm$^2$ and thereafter the nozzle surface of the inkjet head to which the extra ink adhered was wiped with the wiping member. The condition for wiping was a pressing force of 3N. In addition, the nozzle surface was visually observed after wiping at a wiping speed of 30 mm/s, 50 mm/s, and 70 mm/s to evaluate the wiping property of the extra liquid. Specifically, the wiping property of extra liquid (ink) were evaluated according to the following evaluation criteria. The wiping member was determined as practically usable when graded C or above.

Evaluation Criteria

A: Extra ink adhering to nozzle surface was removed by wiping operations at all wiping speeds B: Extra ink on the nozzle surface was removed when the wiping speed was 30 mm/s and 50 mm/s, but remained when 70 mm/s C: Extra ink on the nozzle surface was removed when the wiping speed was 30 mm/s, but remained when 50 mm/s and 70 mm/s D: Extra ink adhering to nozzle surface remained by wiping operations at all wiping speeds

TABLE 1

| | Wiping member | | Average porosity | | | | Wiping property of liquid adhering | Wiping property of extra |
|---|---|---|---|---|---|---|---|---|
| | Structure | Material | P1 | P2 | P3 | P2/P1 | matter | liquid |
| Example 1 | Non-woven fabric (single layer) | Polyolefin | 0.50 | 0.55 | 0.65 | 1.1 | C | C |
| Example 2 | Non-woven fabric (single layer) | Polyolefin | 0.84 | 0.92 | 0.95 | 1.1 | C | C |
| Example 3 | Non-woven fabric (single layer) | Polyolefin | 0.60 | 0.66 | 0.80 | 1.1 | B | B |
| Example 4 | Non-woven fabric (single layer) | Polyolefin | 0.80 | 0.88 | 0.92 | 1.1 | B | B |

TABLE 1-continued

| | Wiping member | | Average porosity | | | | Wiping property of liquid adhering | Wiping property of extra |
|---|---|---|---|---|---|---|---|---|
| | Structure | Material | P1 | P2 | P3 | P2/P1 | matter | liquid |
| Example 5 | Non-woven fabric (single layer) | Polyester | 0.75 | 0.94 | 0.99 | 1.3 | A | A |
| Example 6 | Non-woven fabric (single layer) | Polyester | 0.75 | 0.88 | 0.95 | 1.2 | A | A |
| Example 7 | Non-woven fabric (single layer) | Polyester | 0.75 | 0.80 | 0.85 | 1.1 | A | B |
| Example 8 | Non-woven fabric (single layer) | Polyester | 0.75 | 0.90 | 0.99 | 1.2 | A | A |
| Example 9 | Non-woven fabric (single layer) | Polyester | 0.65 | 0.85 | 0.90 | 1.3 | A | A |
| Example 10 | Non-woven fabric (single layer) | Polyester | 0.60 | 0.84 | 0.86 | 1.4 | A | B |
| Example 12 | Non-woven fabric (multiple layer) | Polyester | 0.75 | 0.94 | 0.99 | 1.3 | C | C |
| Example 13 | Woven fabric | Polyester | 0.75 | 0.94 | 0.99 | 1.3 | C | C |
| Comparative Example 1 | Non-woven fabric (single layer) | Polyolefin | 0.85 | 0.85 | 0.85 | 1.0 | D | D |
| Comparative Example 2 | Non-woven fabric (single layer) | Polyester | 0.85 | 0.70 | 0.60 | 0.8 | D | D |
| Comparative Example 3 | Non-woven fabric (single layer) | Polyester | 0.60 | 0.90 | 0.95 | 1.5 | C | D |
| Comparative Example 4 | Non-woven fabric (single layer) | Polyester | 0.75 | 0.90 | 0.70 | 1.2 | B | D |

In the case of the wiping member having an average porosity unchanged in the vertical direction of the surface as in Comparative Example 1, the adhering ink remained even after wiping operations 10 times and the extra ink remained at all the wiping speeds.

In the case of the wiping member having an average porosity P1 greater than the average porosities P2 and P3 as in Comparative Example 2, the adhering ink remained even after wiping operations 10 times and the extra ink remained at all the wiping speeds.

In the case of the wiping member having a P2/P1 larger than 1.4 as in Comparative Example 3, the extra ink absorbed by the wiping member once adhered to and remained on the nozzle surface again.

In the case of the wiping member having an average porosity P2 larger than the average porosities P1 and P3 as in Comparative Example 4, the extra ink remained at all wiping speeds.

Having now fully described embodiments of the present invention, it will be apparent to one of ordinary skill in the art that many changes and modifications can be made thereto without departing from the spirit and scope of embodiments of the invention as set forth herein.

What is claimed is:

1. A wiping member that wipes a nozzle surface of a liquid discharging head, having:

a first region having an average porosity P1, a second region disposed on the first region, having an average porosity P2 greater than P1; and a third region disposed on the second region having an average porosity P3 greater than P2, wherein the wiping member has a thickness t in a direction perpendicular to a surface that contacts the nozzle surface and each of the first region, the second region, and the third region has a thickness of t/3 in the direction, wherein P2/P1 is from 1.1 to 1.4, wherein the first region forms the surface.

2. The wiping member according to claim 1, wherein the first region extends from the surface to t/3, the second region extends from t/3 to 2t/3, and the third region extends from 2t/3 to t.

3. The wiping member according to claim 1, wherein P1 is from 0.60 to 0.80.

4. The wiping member according to claim 1, wherein the surface of the wiping member comprises non-woven fabric.

5. The wiping member according to claim 1, wherein P1/P2 is from 1.2 to 1.3.

6. The wiping member according to claim 1, wherein the wiping member is a single layer.

7. A wiping method comprising:

wiping a nozzle surface of a liquid discharging head using a wiping member, wherein the wiping member includes: a first region having an average porosity P1; a second region disposed on the first region, having an average porosity P2 greater than P1; and a third region disposed on the second region, having an average porosity P3 greater than P2, wherein the wiping member has a thickness t in a direction perpendicular to a surface that contacts the nozzle surface and each of the first region, the second region, and the third region has a thickness of t/3 in the direction, wherein P2/P1 is from 1.1 to 1.4.

8. The wiping method according to claim 7, wherein the first region extends from the surface to t/3, the second region extends from t/3 to 2t/3, and the third region extends from 2t/3 to t.

9. The wiping method according to claim 7, further comprising applying a cleaning liquid to the wiping member.

10. The wiping method according to claim 7, wherein the cleaning liquid has a surface tension of 35 mN/m or less.

11. A wiping device comprising:

a wiping member configured to wipe a nozzle surface of a liquid discharging head, wherein the wiping member includes a first region having an average porosity P1;

a second region disposed on the first region, having an average porosity P2 greater than P1; and a third region disposed on the second region having an average porosity P3 greater than P2, wherein the wiping member has a thickness t in a direction perpendicular to a surface that contacts the nozzle surface and each of the first region, the second region, and the third region has a thickness of t/3 in the direction, wherein P2/P1 is from 1.1 to 1.4.

12. The wiping device according to claim 11, wherein the first region extends from the surface to t/3, the second region extends from t/3 to 2t/3, and the third region extends from 2t/3 to t.

13. The wiping device according to claim 11, further comprising a cleaning liquid application device configured to apply a cleaning liquid to the wiping member.

14. The wiping device according to claim 11, wherein the cleaning liquid has a surface tension of 35 mN/m or less.

* * * * *